United States Patent [19]

Eriksen

[11] Patent Number: 4,951,753

[45] Date of Patent: Aug. 28, 1990

[54] SUBSURFACE WELL SAFETY VALVE

[75] Inventor: Erik P. V. Eriksen, Broken Arrow, Okla.

[73] Assignee: Baker Hughes Incorporated, Houston, Tex.

[21] Appl. No.: 420,516

[22] Filed: Oct. 12, 1989

[51] Int. Cl.[5] ..... E21B 34/10; E21B 43/12

[52] U.S. Cl. ..... 166/375; 166/321; 166/332

[58] Field of Search ..... 166/374, 375, 321, 323, 166/317, 332; 251/62

[56] References Cited

U.S. PATENT DOCUMENTS

| | | | |
|---|---|---|---|
| 4,161,219 | 7/1979 | Pringle | 166/324 |
| 4,503,913 | 3/1985 | Carmody | 166/319 |
| 4,566,540 | 1/1986 | Pringle et al. | 166/317 |
| 4,796,705 | 1/1989 | Carmody et al. | 166/321 X |
| 4,838,355 | 6/1989 | Leismer et al. | 166/375 |

*Primary Examiner*—Hoang C. Dang

*Attorney, Agent, or Firm*—Hubbard, Thurman, Turner, Tucker

[57] ABSTRACT

In a safety valve having an axially shiftable actuating sleeve operable to move a valve head from a closed to an open position, the actuating movement of the actuating sleeve is normally produced by a small diameter piston mounted on an axially extending spindle secured to the valve housing and cooperating with a primary cylinder which is secured to the actuating sleeve by a shiftable latch. A secondary spindle and cooperating cylinder are provided which are supplied with fluid pressure by an entirely separate line. The secondary cylinder, when moved downwardly by fluid pressure, engages the latch to effect a disconnection of the primary cylinder from the actuating sleeve and concurrently effects the connection of the secondary cylinder to the actuating sleeve. The second cylinder may thus release the primary cylinder from the actuating sleeve in any position of the primary cylinder, including the position corresponding to the fully open position of the valve head. Means are provided on the secondary cylinder for locking the cylinder against return movement when the valve head is shifted to its fully open position.

21 Claims, 8 Drawing Sheets

SUBSURFACE WELL SAFETY VALVE

BACKGROUND OF THE INVENTION

1. Field of the Invention

The invention relates to a safety valve used in subterranean wells, such as oil or gas wells, and specifically to valves which are actuated in response to changes in a control fluid pressure applied by one or more control lines extending from the subsurface valve location to the well surface.

2. Description of the Prior Art

Subsurface safety valves are commonly used in oil or gas wells to prevent the escape of fluids from a producing formation in the event of damage to the well conduits or to the surface elements of the well. Typically such safety valves are incorporated into the production fluid transmission tubing which is inserted through the well casing and extends from the surface of the well to the producing formation. The flow of fluids through this inner tubing string must be interrupted in the event of damage to the upper portions of the casing, the tubing string or to the well head. By positioning these valves at a location below the well surface, for example, below the mudline in an offshore well, the safety valve can be closed to prevent the escape of produced fluids.

The most common subsurface safety valves employ either a pivoted flapper or a rotatable ball valve head to open and close the transmission conduit. Commonly, the valve head is actuated from a closed to an open position in response to axial movement of an actuator sleeve.

In recent years, subsurface safety valves have utilized small diameter, axially shiftable pistons or cylinders for moving the actuator sleeve. Such movable pistons or cylinders are disposed in an annular space intermediate the exterior of a central production flow conduit and the outer wall of a valve housing which is secured in series relationship in the production tubing string. Prior art constructions are known wherein the cylinders for such pistons are fixedly mounted in the valve housing, or alternatively, the spindle or piston rods are fixedly secured to the valve housing and the cooperating cylinders are movable relative to the fixed piston rods. U.S. Pat. Nos. 4,005,751, 4,119,146, and 4,161,219 each disclose subsurface safety valves having a spool or piston mounted in the valve housing and operatively connected to the valve actuator sleeve. U.S. Pat. No. 4,503,913 discloses a subsurface safety valve actuator having a piston rod secured to the valve housing and a cooperating cylinder operatively connected to the valve actuator sleeve.

Occasionally, a defect or leak in the small cylinder or piston will prevent the development of sufficient force to shift the valve actuator sleeve to a valve opening position. In such case, the availability of a backup hydraulic system, including a separate hydraulic line extending to the well surface is a desirable adjunct. More importantly, if the primary piston or cylinder is not operable, it becomes desirable that the safety valve be shifted to, and locked in, an open position to insure that wireline tools may be inserted through the safety valve to effect the control of other tools located downhole relative to the safety valve. An apparatus for effecting this backup actuation of the safety valve and/or the locking of the safety valve in a fully open position is disclosed in U.S. Pat. No. 4,796,705.

One disadvantage of the construction shown in U.S. Pat. No. 4,796,705 is the fact that the primary actuating cylinder remains engaged with the actuating sleeve during the movement of the sleeve to its fully open position by a movable secondary cylinder. Thus, additional fluid pressure must be applied to the secondary cylinder to counteract the upwardly directed force of the well fluids acting on the lower surface of the primary cylinder. There is a need, therefore, for an improved apparatus utilizing primary and secondary cylinders to actuate a downhole safety valve to reduce the amount of hydraulic pressure required to operate the secondary cylinder to effect the downward displacement of the valve actuating sleeve to its valve open position, and the locking of the mechanism in such position.

SUMMARY OF THE INVENTION

Primary and secondary actuating cylinders are provided for an actuating sleeve of a downhole safety valve in a similar manner as disclosed in the aforementioned U.S. Pat. No. 4,796,705, the disclosure of which is incorporated herein by reference. Instead of the primary cylinder being attached to the actuating sleeve and hence movable with the actuating sleeve even when the sleeve is being moved by the secondary cylinder, the primary cylinder operated in accordance with this invention is connected to the actuating sleeve by an abutting connection for opening movement and solely by a shiftable latch for valve closing movement. When it becomes desirable to effect the operation of the downhole safety valve by the secondary cylinder, a latch engaging plunger on the bottom end of the secondary cylinder engages the shiftable latch and effects the disconnection of the primary cylinder from the actuating sleeve, while, at the same time, effecting the connection of the secondary cylinder to such actuating sleeve. Thus, the force required to produce further downward movement of the actuating sleeve by the secondary cylinder is substantially reduced since the primary cylinder is now independent of the actuating sleeve and hence any upward bias on the primary cylinder produced by well fluids is not transmitted to the actuating sleeve.

The supply of control fluid to the secondary cylinder is also accomplished in a unique manner in accordance with this invention. A secondary valve housing is clamped to the tubing string at a position above the main housing of the safety valve and such valve housing defines an axially extending flow passage. The upper end of such flow passage is connected to a small diameter control conduit running to the well surface, while the lower end of the flow passage is connected to the conduit in the valve housing which supplies the secondary cylinder with control fluid.

Interposed in such fluid passage is a metallic check valve which prevents upward flow of fluid through the flow passage. Thus, it is insured that well fluids cannot rise to the surface through the control conduit supplying the secondary cylinder. Additionally, a frangible barrier is sealingly mounted across the flow passage to prevent the inadvertent operation of the secondary cylinder during run-in or other preliminary operations of the well. The frangible barrier is selected to prevent the flow of control fluid through the flow passage until the pressure of the secondary control fluid has been raised to a predetermined level. Thus, a definitive action must be taken with the secondary control fluid before any of it is supplied to the secondary cylinder. Lastly, a frangible sealing disc is welded between the secondary cylinder and a shoulder on the secondary spindle to prevent well fluids from entering the secondary cylinder prior to application of the preselected pressurized control fluid.

Further advantages of the method and apparatus embodying this invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
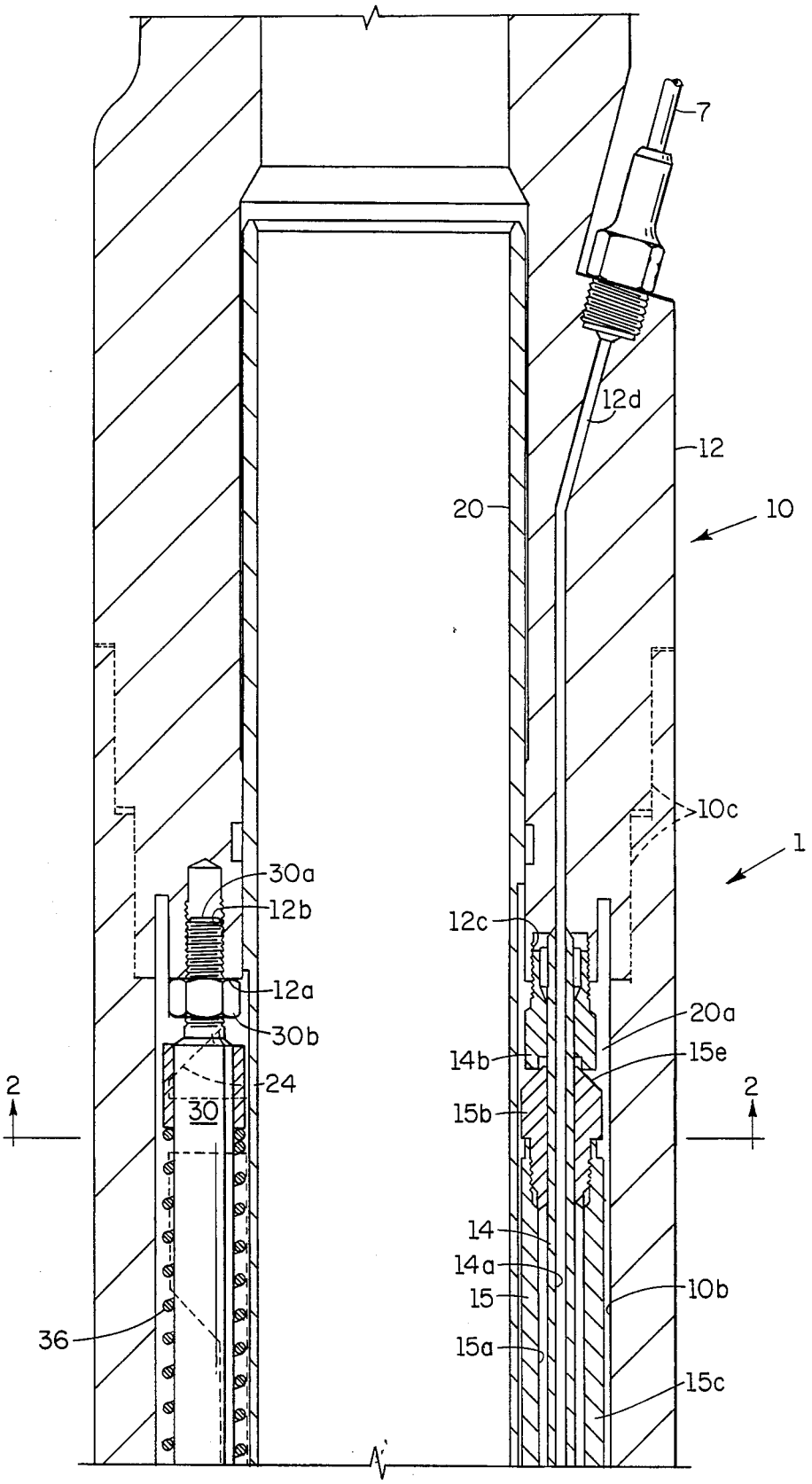
FIGS. 1A, 1B and 1C collectively constitute a vertical, sectional view of a downhole safety valve embodying this invention, with the safety valve shown in its closed position.
Figure 1B:
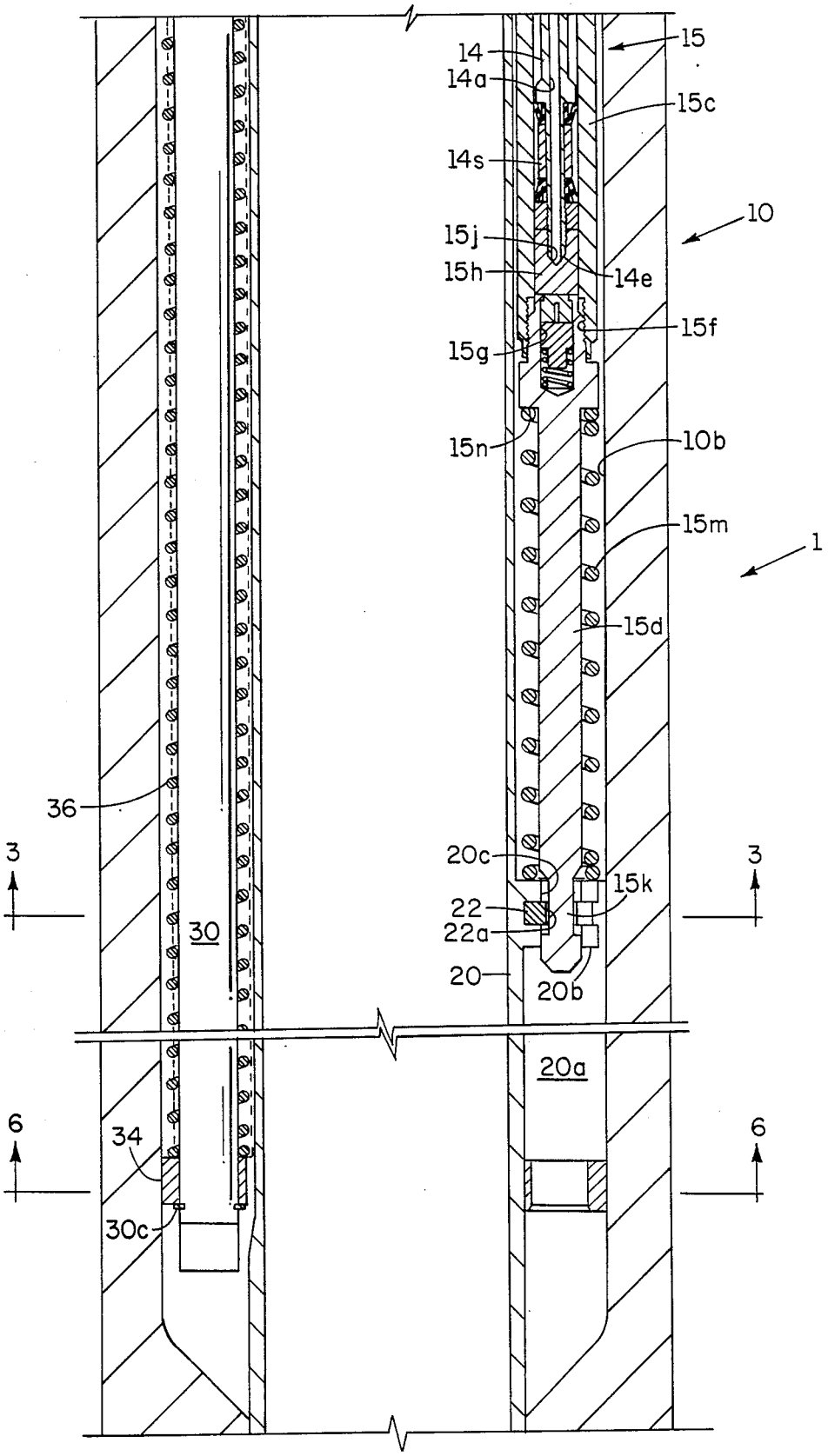
Figure 1C:
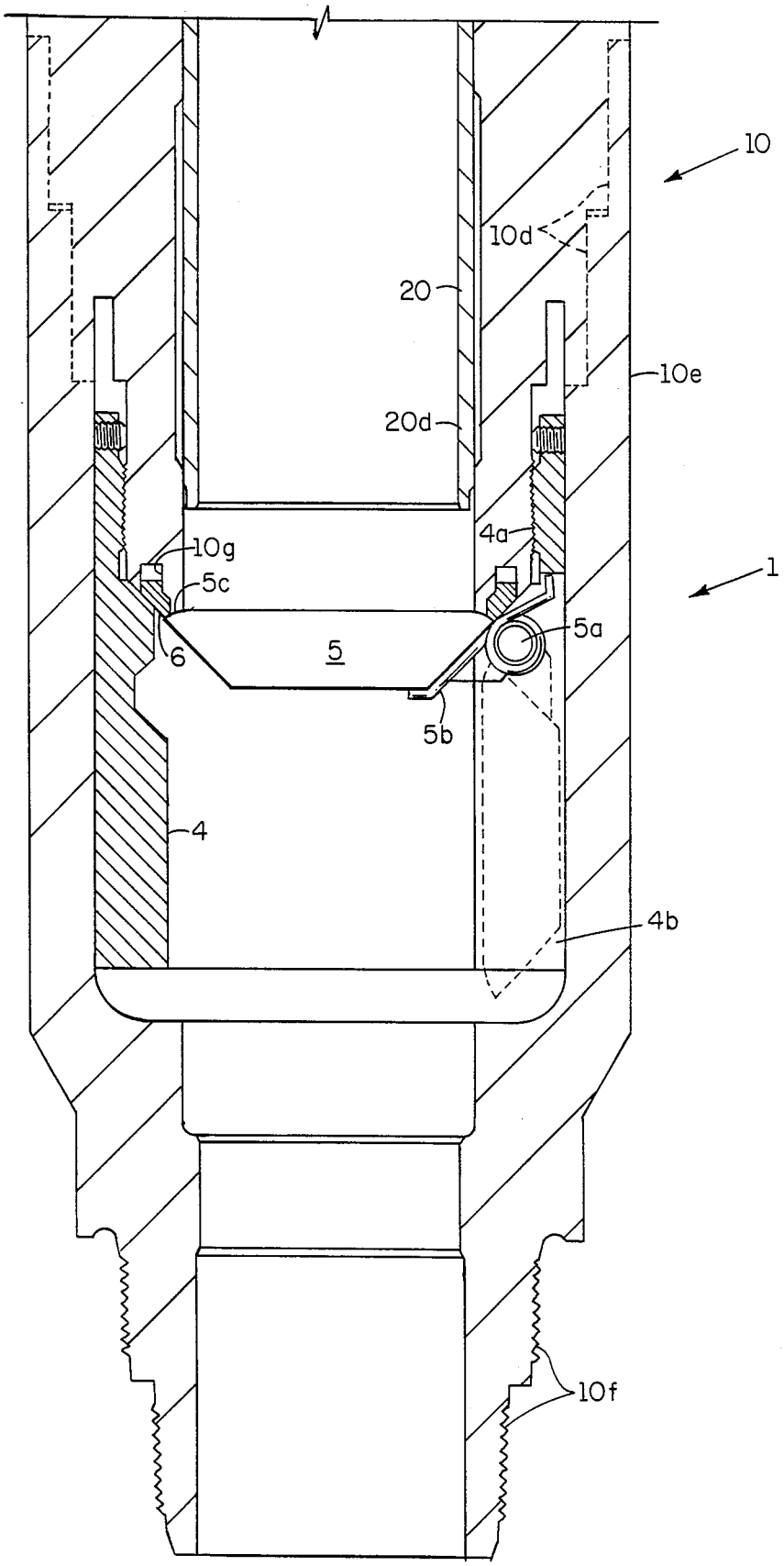

Referring to FIGS. 1A, 1B and 1C, a safety valve 1 embodying this invention comprises an outer housing assembly 10, a shiftable valve head, in this instance, a flapper valve 5, and an actuating sleeve 20 concentrically mounted for axial movement within the bore of the outer housing assembly 10 and defining an annulus **20*a* surrounding a major portion of the exterior of the actuator sleeve 20 and bounded by an enlarged diameter lower bore portion 10*b* of the outer housing assembly 10**.

A top sub 12 is provided on housing assembly 10 which has conventional means at its upper end (not shown) for threadably connecting to a production tubing string TS (FIG. 7) extending to the well surface. The lower end of top sub 12 is conventionally connected by threads **10*c* to the upper end of the outer housing assembly 10. The lower end of top sub 12 terminates in an inner annular planar surface 12*a* which is provided with a plurality of internally threaded, peripherally spaced vertical holes 12*b*. The majority of such holes threadably receive the upper ends 30*a* of downwardly extending guide rods 30. Lock nuts 30*b*** secure the threaded connections.

Figure 6:
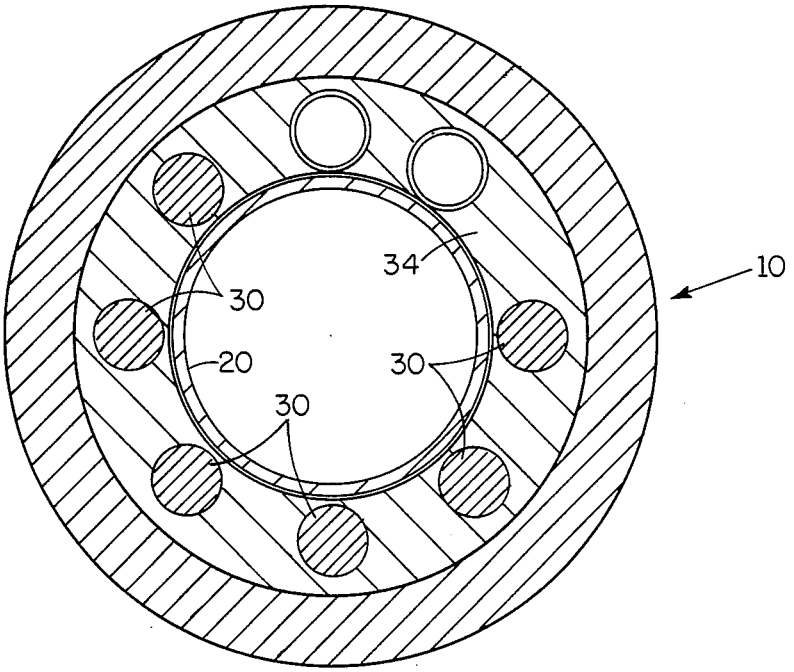
FIG. 6 is a sectional view taken on the plane 6—6 of FIG. 1B.
Figure 7:
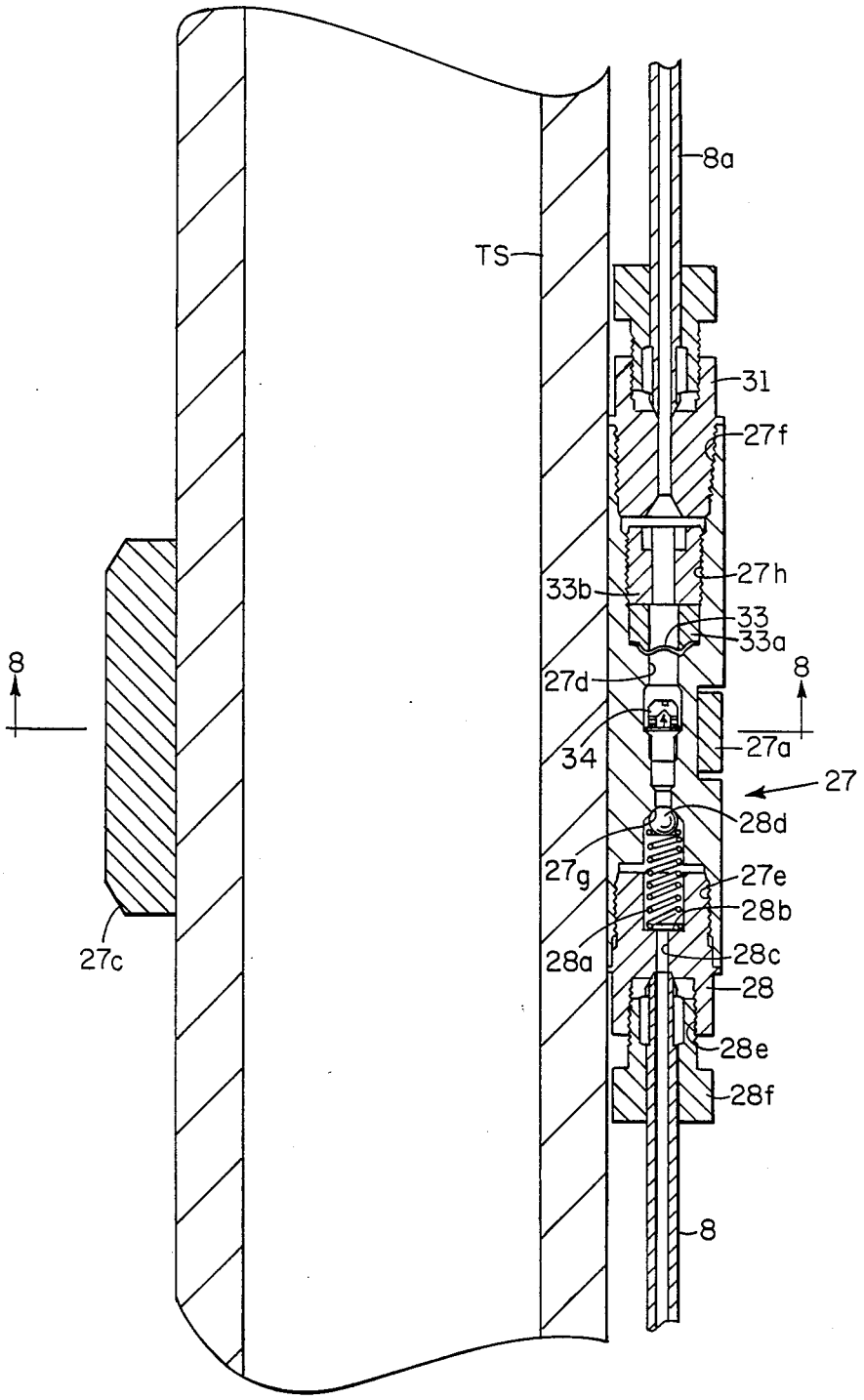
FIG. 7 is a vertical, sectional view of a fluid supply housing for the secondary cylinder mounted on the production tubing at a location above the safety valve.

At least two adjacent larger holes **12*c* respectively mount a primary hollow spindle 14 and a secondary hollow spindle 16 in side by side adjacent relationship in annulus 20*a*. A pair of axially extending fluid supply passages 12*d* (of which only one is shown) are provided in top sub 12 in respective communication with the internal bores 14*a* and 16*a* of each of the hollow spindles 14 and 16. Conventional piping connects the primary hollow spindle 14 to a control tubing 7 leading to a source of control fluid at the well surface (not shown) while the supply passage 12*d* for the secondary hollow spindle 16 is connected by a pipe 8 to a valve housing 27 secured in surrounding relationship to the tubing string TS as shown in FIGS. 6 and 7. The valving components contained in valve housing 27** will be later described in detail.

The lower portion of the outer housing assembly 10 is provided with external threads **10*d* which cooperate with corresponding internal threads provided on the upper end of a valve mounting housing 10*e*. The bottom end of the valve mounting housing 10*e* is provided with external threads 10*f*** for mounting the tubular upper end of any appropriate well tool or tubing string (not shown) which extends downwardly to the production zone of the well.

The flapper valve 5 is shown in its closed position in FIG. 1C wherein the bottom end portion **20*d* of the actuator sleeve 20 is positioned above the flapper 5. Flapper 5 is mounted in the valve mounting housing 10*e* on a transverse pin 5*a* and is biased to a closed position by a torsion spring 5*b*, wherein it traverses the internal bore of the tubular housing assembly 10. In such closed position, a sealing surface 5*c* provided on the periphery of the flapper valve 5 sealingly abuts metal and/or elastomeric sealing surfaces provided on a seal seat 6 which is mounted within an annular bore 10*g* formed in the bottom end of the valve mounting housing 10*e* and retained therein by a sleeve 4 which is secured by threads 4*a* to the bottom of the main housing assembly 10. Downward movement of valve actuating sleeve 20 will force the flapper valve 5 to its dotted line position shown in FIG. 1C where the flapper 5 is positioned in a recess 4*b* formed in the wall of sleeve 4**.

The primary hollow spindle 14 is slidably and sealably surrounded by a primary cylinder 15. A dynamic piston seal assembly **14*s* (FIG. 1B) is provided on the lower portion of primary spindle 14 and cooperates in sealing relationship with the bore wall 15*a* of cylinder 15. Seal assembly 14*s* may comprise any one of several well known piston sealing arrangements, and, if extreme pressure and temperature conditions are to be encountered, such seal assembly is preferably of a non-elastomeric nature, such as shown in U.S. Pat. No. 4,743,033. The specific nature of the seal assembly 14*s*** forms no part of the present invention, hence will not be described in detail.

Primary cylinder 15 is formed by a threaded assembly of three tubular components, respectively an upper sealing sleeve **15*b*, a central cylinder bore defining sleeve 15*c* and a lower solid latching portion 15*d*. Referring to FIG. 1A, the upper end of sealing sleeve 15*b* has a conical configuration 15*e* and cooperates, when cylinder 15 is in its uppermost position, with a metallic seal seat sleeve 14*b* which is threadably secured in one of the enlarged threaded holes 12*c* provided in the bottom surface 12*a* of the top sub 12. Seal seat sleeve 14*b* also effects the sealed securement of the top end of primary spindle 14 to the bottom surface 12*a* of the top sub 12**.

The central cylinder bore portion **15*c* (FIG. 1B) of cylinder assemblage 15 is secured by threads 15*f* to the top end of the solid latching portion 15*d* of the cylinder assembly 15. The top end of the latching portion 15*d* is provided with an open ended bore 15*g* in which is suitably mounted a valve seat element 15*h* which defines a conical valve seat 15*j*. Conical valve seat 15*j* cooperates in sealing relationship with a downwardly facing conical surface 14e provided on the bottom end of the primary hollow spindle 14. Thus, when no fluid pressure is applied to the internal bore 14a of spindle 14, the primary cylinder assembly 15 is biased upwardly by the spring forces acting on it and the actuating sleeve 20, as will be described. The passage of fluid through the bore 14a of the hollow spindle 14 is prevented by the metallic seal between the conical seal seat 15j and the conical bottom end 14e of the primary hollow spindle 14. Primary cylinder assembly 15 is biased upwardly by a spring 15m which operates between actuating sleeve shoulder 20b and a shoulder 15n defined on the top end of solid portion 15d** of primary seal assembly.

The bottom end of the latching portion 15d of the primary cylinder assembly 15 is detachably connected to the cylinder sleeve 20. As best shown in FIGS., 1B and 3, the medial portion of the actuating sleeve 20 is provided with a radial projection 20b which intersects the path of movement of the primary cylinder 15 and also the secondary cylinder assembly 17, as will be described. The projection 20b is provided with a pair of adjacent vertical holes 20c and the bottom end of the solid actuating portion 15d of the primary cylinder assembly 15 normally projects through one of such holes. A horizontal slot 20e is provided traversing the holes 20c and in this slot, a shiftable latch 22 is mounted. Latch 22 is provided with one vertical hole 22a which can be aligned with the holes 20c and thus permit free passage of the primary cylinder assemblage 15 upwardly. Latch 22 is held in its normal position partially blocking both holes 20c by a shear pin 23 and, in this position, the side wall of the hole 22a in the latch 22 engages a transverse slot 15k provided in the bottom end of acutating portion 15d of the primary cylinder assembly 15 and effectively locks the primary cylinder assembly to the actuating sleeve 20. As will be later described, the latch 22 may be transversely shifted relative to the primary cylinder 15 and released therefrom by downward movement of the secondary cylinder assembly 17. The secondary hollow spindle 16 and its cooperating secondary cylinder assembly 17 will now be described in detail.

Figure 4A:
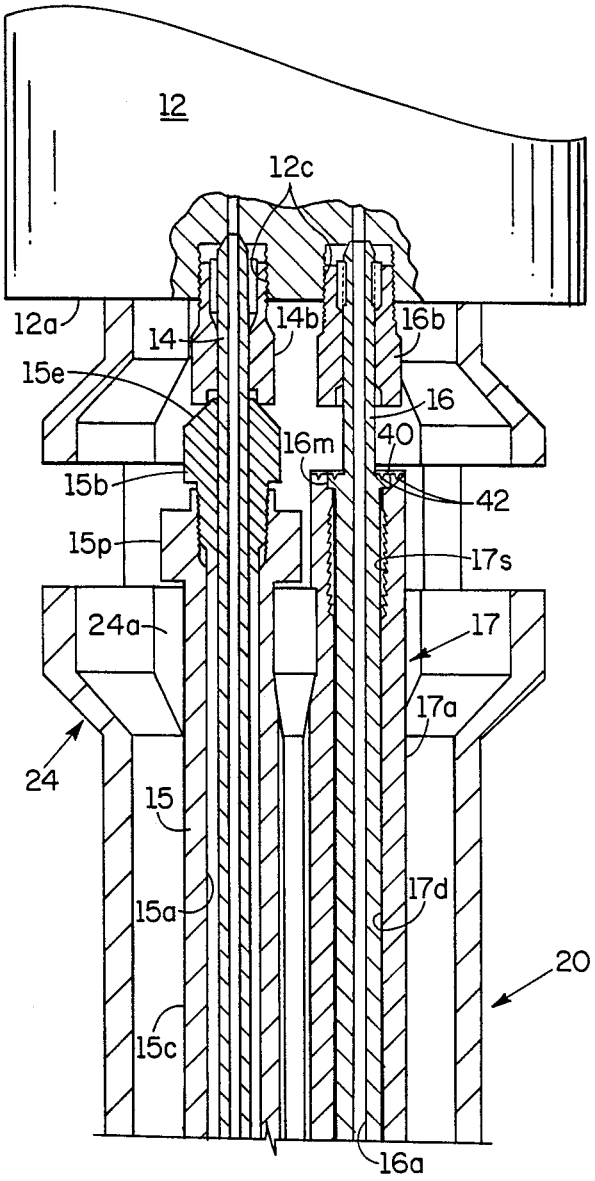
FIGS. 4A and 4B collectively represent a vertical, sectional view taken on the plane 4—4 of FIG. 2.
Figure 4B:
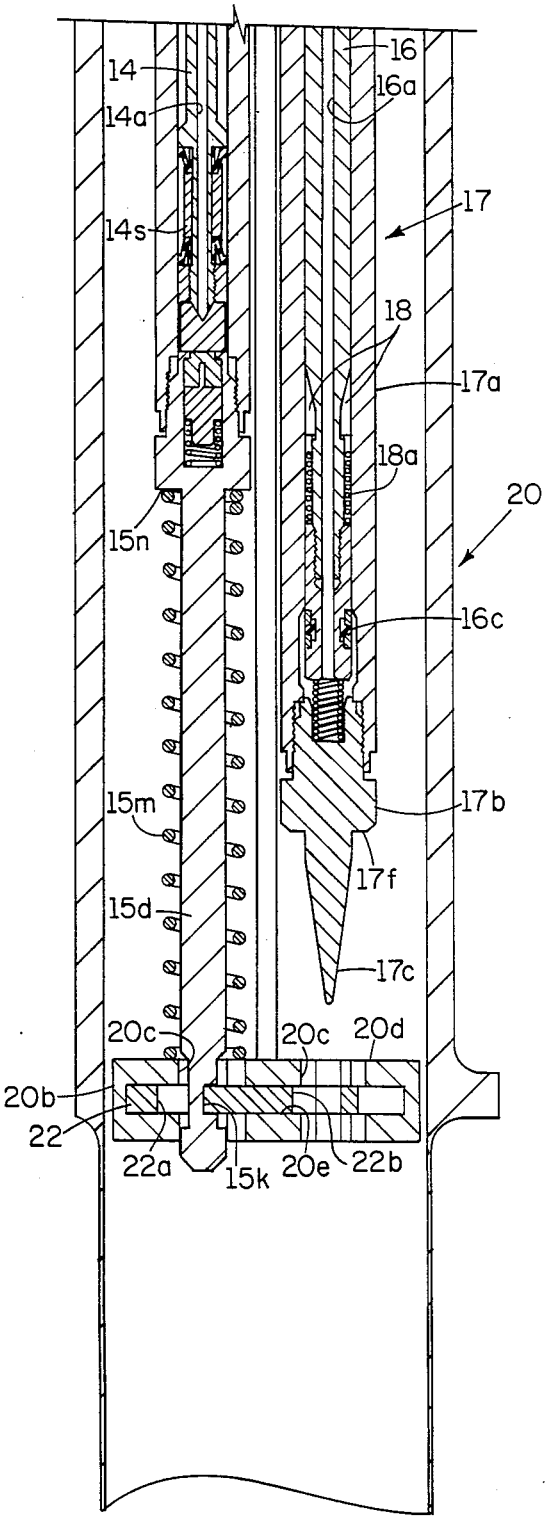

Secondary hollow spindle 16 secured in the bottom face 12a of the top sub 12 by a seal sleeve 16b which functions in the same manner as the seal sleeve 14b for the primary hollow spindle 14 (FIG. 4A). A secondary cylinder assembly 17 slidably and sealably cooperates with the secondary hollow spindle 16, however, the total length of secondary cylinder assembly 17 is less than the length of the primary cylinder assembly 15, as shown in FIG. 4B. The secondary spindle assembly comprises a cylinder body element 17a which is threadably connected at its lower end to a solid actuating element 17b having a conically shaped, depending end portion 17c which engages the side wall of a second hole 22b of latch 22 to horizontally shift the latch 22 from a position of engagement with the primary cylinder assembly 15 and into engagement with the secondary cylinder assembly 17 when the secondary cylinder assembly 17 is moved downwardly through the application of fluid pressure to the hollow bore 16a of the secondary hollow spindle 16.

A piston type dynamic seal assembly 16c is provided adjacent the lower end of the hollow secondary spindle 16 to sealably cooperate with the internal bore 17d of the cylinder portion 17b. While seal assembly 16c may be of any conventional type, we preferably employ a dynamic sealing element 16c to effect the seal and rely upon a metal-to-metal check valve, to be described later in connection with FIG. 7, to prevent upward flow of well fluids through the fluid conduit supplying control fluid to the secondary cylinder assembly 17.

The operation of the shiftable latch 22 by downward movement of the secondary cylinder assembly 16 will be readily apparent from FIGS. 4A and 4B. The second vertical hole 22b provided in the latch 22 receives the conical end portion 17c of the secondary cylinder assembly 17 and such conical surface applies a tranverse force to the latch 22, thus severing the shear pin 23 and shifting the latch out of engagement with the primary cylinder assembly 15 and into latched engagement with the conical end 17c of the secondary cylinder assembly, preferably through the engagement of a radial shoulder 17f on the upper end of the conical portion 17c with the upwardly facing surfaces 20d surrounding the vertically extending holes 20c which extends through the radial shoulder 20b provided on the actuating sleeve 20.

Figure 5A:
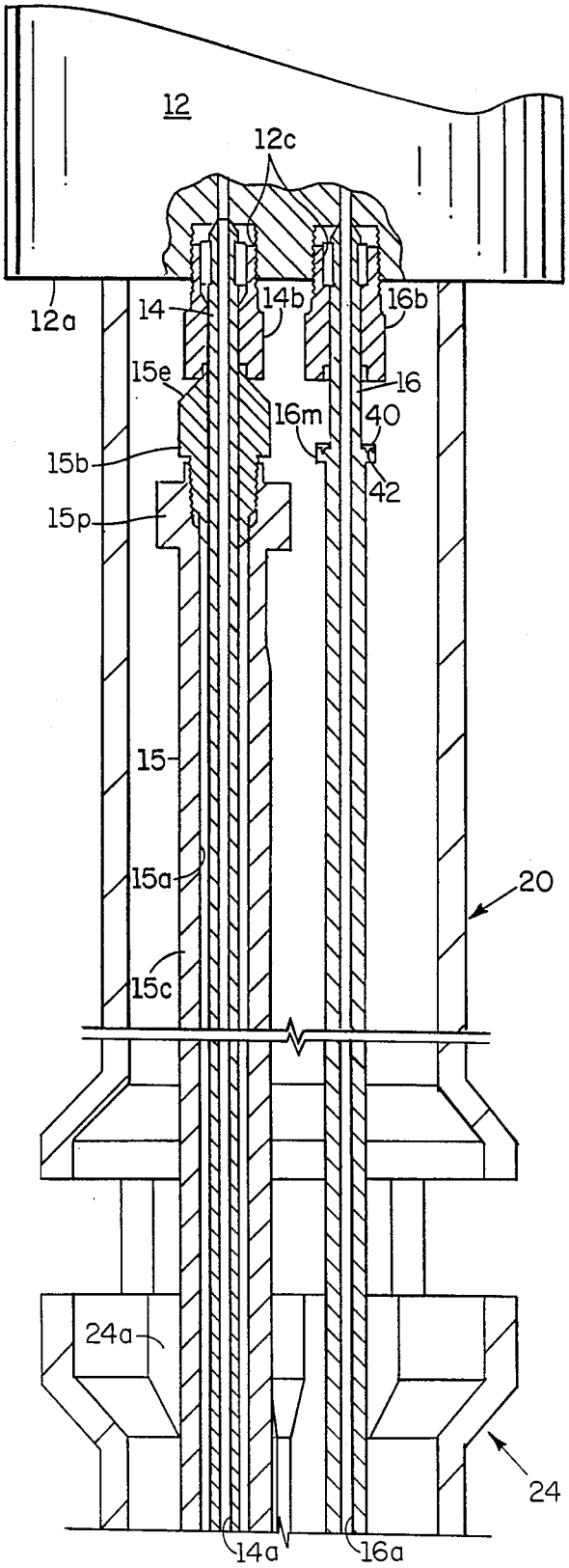
FIGS. 5A and 5B are sectional views corresponding to FIGS. 4A and 4B but illustrating the operation of the actuating sleeve for the safety valve by the secondary cylinder, which has effected the disconnection of the primary cylinder to the actuating sleeve.
Figure 5B:
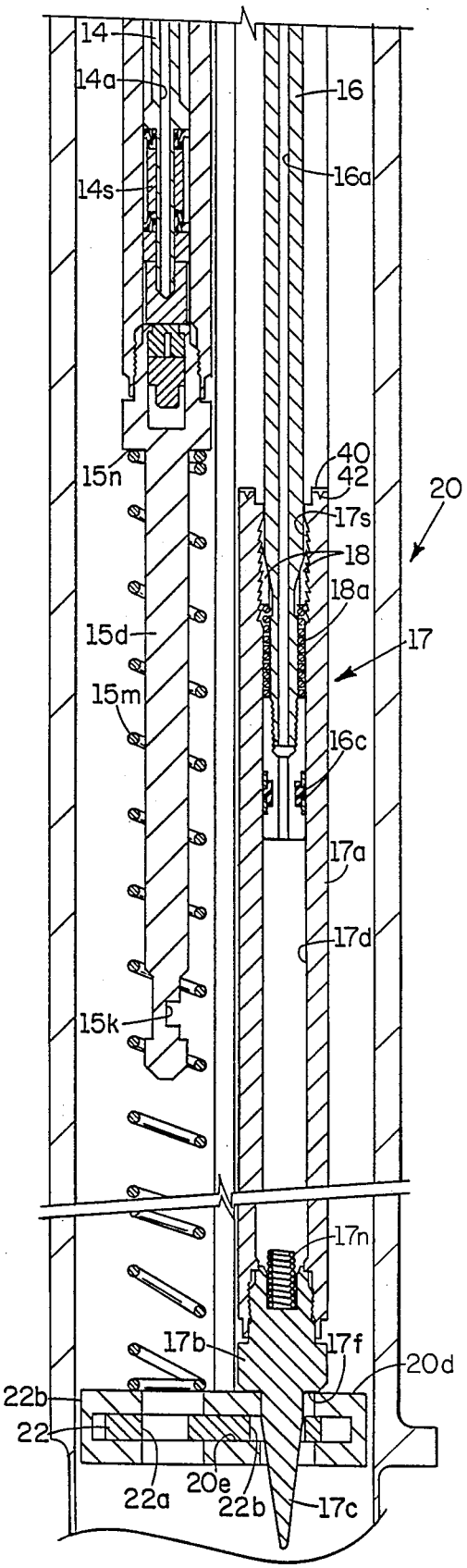

It should be particularly noted that the secondary cylinder assembly 17 can effect the release of the latch 22 from the primary cylinder assembly 15 at any axial position of the primary cylinder assembly ranging from the valve closed position shown in FIG. 4B to a fully open position of the safety valve which is not illustrated. At whatever position the latch is released from the primary cylinder assembly 15, such assembly is immediately free from any direct connection to the actuating sleeve 20 and will be forced upwardly by the pressure of well fluids to a position abutting a downwardly facing shoulder provided on the seal seat sleeve 14b. Thus, the upward force exerted by well fluids on the primary cylinder assembly 15 does not have to be overcome by the fluid pressure supplied to the secondary cylinder assembly 17 and such cylinder assembly 17 can move the actuating sleeve 20 downwardly to its lowermost position illustrated in FIG. 5B where the valve head 5 is shifted to its valve open position.

Locking of the valve head 5 in its fully open position is accomplished by a plurality of radially shiftable lock or slip elements 18 mounted on secondary spindle 16 above seal element 16c and biased outwardly by a spring 18a. Lock elements cooperate with wicker threads 17s provided in a counterbore in the upper end of secondary cylinder assembly 17.

Figure 2:
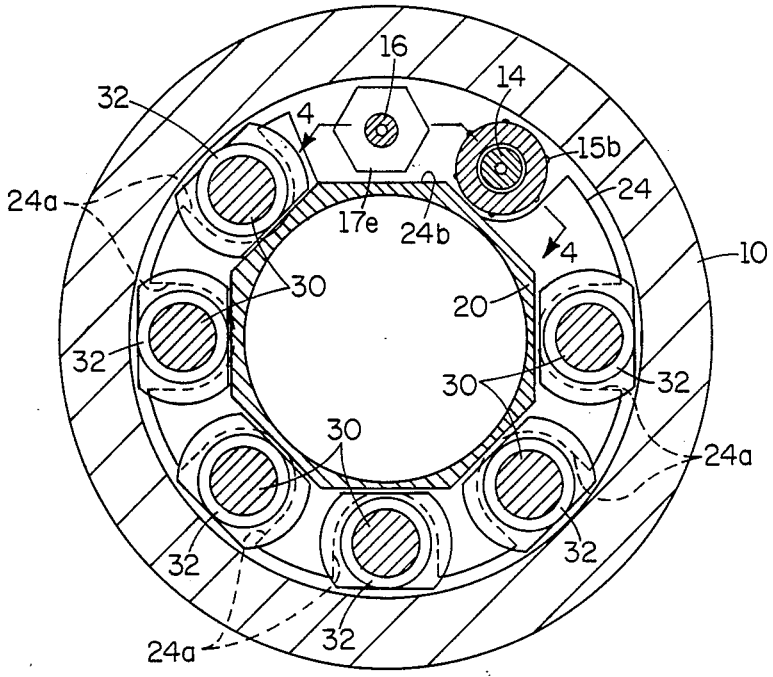
FIG. 2 is a sectional view taken on the plane 2—2 of FIG. 1A.
Figure 3:
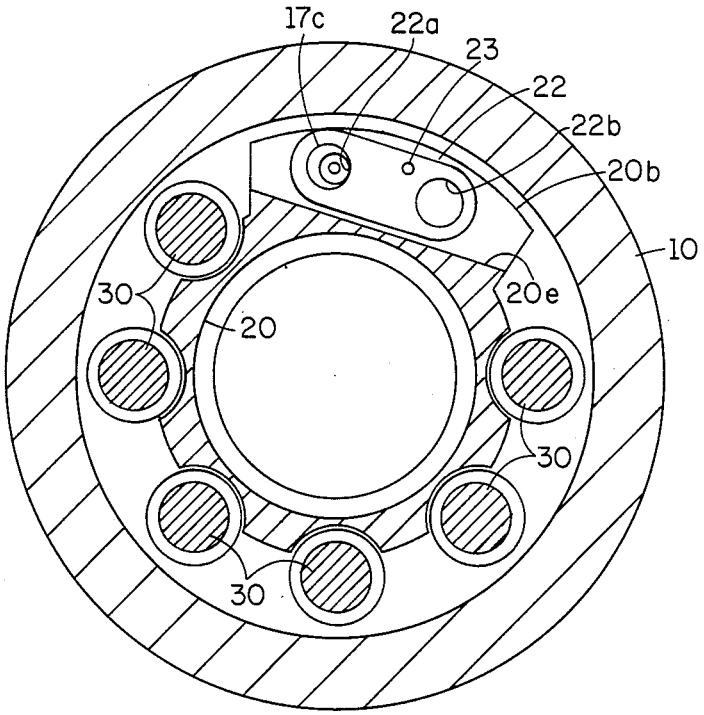
FIG. 3 is a sectional view taken on the plane 3—3 of FIG. 1B.

The valve actuator sleeve 20 is also provided at its upper medial portion with a peripherally extending radial flange 24 (FIG. 2). Flange 24 is provided with a plurality of peripherally spaced notches 24a for respectively receiving guide sleeves 32 through which the guide rods 30 are respectively inserted. Guide sleeves 32 have radially extending shoulders 32a which underlie the solid portions of radial flange 24 of the actuator sleeve 20. In addition, the peripheral flange 24 of valve actuating sleeve 20 is provided with an enlarged notch 24b which receives the primary cylinder assembly 15 and the secondary cylinder assembly 17 in side by side relationship. The primary cylinder 15 is provided with an annular flange 15p which overlies the adjacent edges of the notch 24b so that downward movement of the primary cylinder assembly 15 produces a downward movement of the actuating sleeve 20 and guide sleeve 32. The secondary cylinder assembly 17 has no projecting shoulders at its top end and hence the actuating sleeve 20 can move downwardly independent of the secondary cylinder 17 until secondary cylinder 17 is energized by pressurized control fluid to effect engagement of its bottom actuating portion 17*b* with the latch 22 and hence effect movement of the actuating sleeve downwardly so long as sufficient fluid pressure is maintained within the secondary cylinder 17.

An annular spring seat 34 surrounds the actuating sleeve 20 and is traversed by the bottom ends of control rods 30 and secured thereto by C-rings 30*c*. See FIGS. 1B and 6. A power spring 36 surrounds each of the control rods 30 and operates between the spring seat 34 and the guide sleeve 32 to impart an upward bias to the actuating sleeve 20 to move to its valve closing position. Obviously, it may not be necessary to provide a power spring around each of the guide rods if the number of power springs provided is adequate to comply with the regulations regarding the fail safe movements of the actuating sleeve 20 to its valve closing upper position.

Figure 8:
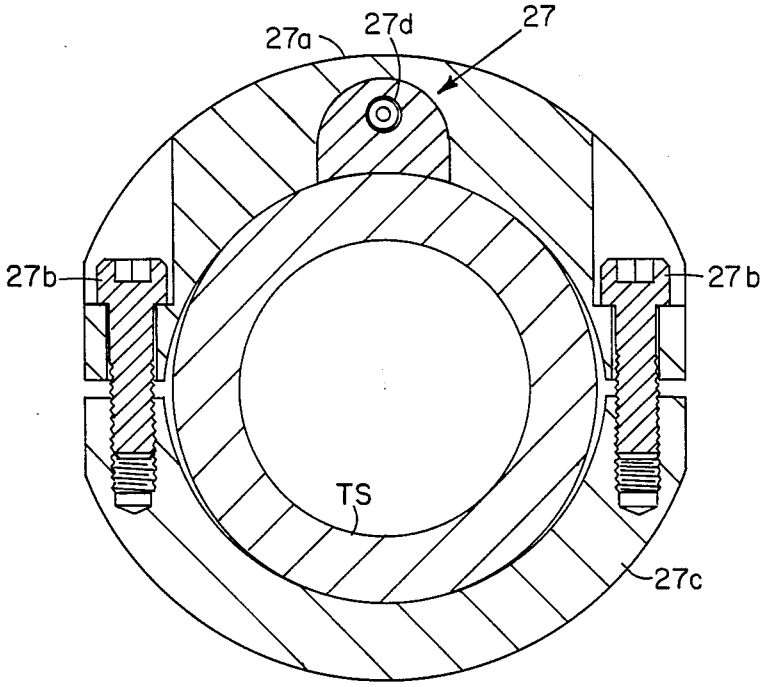
FIG. 8 is a sectional view taken on the plane 8—8 of FIG. 7.

In prior art constructions, such as illustrated in the aforementioned U.S. Pat. No. 4,796,705, the secondary cylinder for effecting the locking of the safety valve in its open position is supplied with pressured control fluid through a separate conduit leading to the surface. In accordance with this invention, a valve housing 27 is inserted in such conduit. Such valve housing is shown in FIGS. 7 and 8. Valve housing 27 comprises a generally cylindrical segment element which is secured by bolts 27*b* between semi-cylindrical retaining clamps 27*a* and 27*c*. As previously mentioned, the valve housing 27 is preferably clamped to the production tubing string TS at a location above the safety valve housing 10. Valve housing 27 defines an axial passage 27*d* which is provided with an enlarged internally threaded counterbore 27*e* at its lower end and an enlarged internally threaded counterbore 27*f* at its upper end. A spring seat sleeve 28 is mounted within the lower counterbore 27*e* and a spring 28*a* abuts against a ledge formed by a counterbore 28*b* in the central bore 28*c* of the spring seat 28. The spring 28*a* forces a ball check valve 28*d* against a downwardly facing conical seat 27*g* formed around the central fluid passage 27*d*. The lower end of spring seat 28 is provided with an enlarged internally threaded counterbore 28*e* which receives a conventional pipe fitting 28*f* anchoring the upper end of the pipe 8 thereto. It will be recalled that pipe 8 communicates with the hollow spindle 16 and hence to the interior of the secondary cylinder 17.

The upper counterbore 27*f* in the valve housing 27 receives a conventional pipe anchor 31 by which a control fluid pipe 8*a* extending to the well surface is sealably anchored to the valve housing 27. Immediately below the pipe anchor 31, a smaller diameter internally threaded counterbore 27*h* is formed in the fluid passageway 27*d* and a frangible diaphram 33 is disposed in transverse relationship to the axial passageway 27*d* by a hollow plug element 33*a* and a hollow nut 33*b* which is threadably engaged with the internal threads 27*h*. The strength of the diaphragm 33 is selected so as to be fracturable at a predetermined fluid pressure typically in excess of several thousand p.s.i..

Immediately below the frangible diaphragm 33, a filter element 34 is mounted so as to trap pieces of the diaphragm 33 when it ruptures and keep such pieces out of the fluid stream passing downwardly through the ball check valve 28*d* and thence into the control fluid conduit 8.

The entire space intermediate the frangible diaphragm 33 and the frangible disc 40 provided on the top end of the secondary cylinder 17 to seal the annular clearance between the interior of the movable cylinder 17 and the exterior of a flange 16*m* provided on the secondary hollow spindle 16, is sealed at the well surface to maintain an atomospheric pressure in such space. Thus, it is assured that the frangible diaphragm 33 will not be subjected to the pressure of well fluids in order to ensure an operative pressure independent of the tubing pressure.

Since the secondary cylinder assembly 17 may be in the well for years prior to the need for its actuation, it is highly desirable that well fluids, with their inherent corrosive properties, have no opportunity to enter the interior of the secondary cylinder assembly even by minute leakage through conventional seals provided in the annulus between the secondary cylinder bore 17*d* and the exterior of the secondary hollow spindle 16. For this reason, an integral leak proof seal is provided for such annulus comprising a shearable metal disc 40 (FIG. 4A) which is secured by annular welds 42, or other means, such as glue, solder or threads, across the top end face of the upper cylinder portion 17*a* and an enlarged shoulder 16*m* provided on the upper portion of secondary spindle 16. Thus sufficient hydraulic force must be applied to cylinder assembly 17 to shear sealing disc 40. If desired, a compressed spring 17*n* may be provided between the solid actuator portion 17*b* of secondary cylinder assembly and the bottom of secondary spindle 16 to help initiate the downward movement of secondary cylinder assembly after seal disc 40 is sheared.

The operation of the aforedescribed apparatus will be readily apparent to those skilled in the art. The normal shifting of the safety valve from its spring biased closed position to its full open position is accomplished through the application of fluid pressure through the primary control line to the hollow spindle 14 and is thus effective to operate against the closed end wall surface of the cylinder assembly 15 to effect the downward movement of such cylinder assembly. Such downward movement of the cylinder assembly 15 produces a downward displacement of the actuating sleeve 20 and a concurrent compression of the power springs 36 mounted on the guide rods 30.

So long as the control fluid pressure is maintained in the primary cylinder 15 at a sufficient level to overcome the upward bias of the power springs 36 surrounding the guide rods 30, the valve actuating sleeve 20 will remain in its lowermost valve opening position and the flapper valve 5 will thus be held in its full open position as shown in FIG. 1C. Upon a decrease in control fluid pressure applied to the primary cylinder 15, the power springs 36, aided by the pressure of the well fluids acting on the primary cylinder 15, will force the primary cylinder assembly upwardly, thus shifting the actuating sleeve 20 to its upper valve closing position and permitting the flapper valve 5 to close under the bias of its torsion spring.

During all of these normal operations of the safety valve by the primary cylinder assembly 15, the secondary cylinder assembly 17 remains in its uppermost position as shown in FIGS. 4A and 4B. If, however, the primary cylinder assembly 15 fails to produce opening movement of the flapper valve 5, for any reason, or if it is desired to lock the flapper valve 5 in an open position, then a secondary control fluid pressure is applied to the secondary fluid conduit 8*a* extending from the well surface to the valve housing 27. When such secondary control fluid pressure reaches a magnitude equal to the breaking strength of the frangible diaphragm 33, preferably on the order of 12,000 p.s.i., such diaphragm breaks and permits the secondary control fluid pressure to be applied to the interior of the secondary spindle 16, thus exerting a downward force on the closed bottom end of the secondary cylinder assembly 17. Such cylinder assembly does not move until the applied downward force is sufficient to effect the shearing of the welded disc seal element 40 which extends across the top end of cylinder 17 and the top face of the shoulder 16*m* provided on secondary spindle 16. When the seal disc 40 is ruptured, the secondary cylinder assembly 17 moves downwardly and the cone-shaped bottom end 17*c* of the secondary cylinder assembly 17 engages the latch 22 and shifts the latch laterally, or in a plane perpendicular to the axis of the main housing, to concurrently release the latch from the primary cylinder 15 and to effect the engagement of the secondary cylinder assembly 17 with the annular shoulder 20*b* provided on the actuating sleeve 20 within which the latch 22 is shiftably mounted. The secondary cylinder assembly 17 may thus complete the downward movement of the actuating sleeve 20 to its full valve open position and thus pivot the flapper valve 5 to its open position. When the secondary cylinder 17 assembly reaches such full open position, the radially shiftable locking elements 18 are urged outwardly into engagement with the wicker threads provided in the counter bore in the upper end of the secondary cylinder 17. Such engagement prevents any return upward movement of the secondary cylinder and hence permanently locks the flapper valve 5 in its open position.

When the primary cylinder assembly 15 is moved upwardly by well fluids and the compression of the spring 15*m* which surrounds the lower solid end 15*d* of the primary cylinder 15, a metal-to-metal seal is accomplished between the bottom end of the hollow spindle 14 and the conical recess provided in the top end of the upper portions of the closed bottom end of the primary cylinder 15. Conversely, when the primary cylinder 15 is in its uppermost position as shown in FIG. 4A, a metal-to-metal seal is also established between the conical surface 15*e* of the head portion 15*b* of the primary cylinder 15 and a downwardly facing corner surface provided on the plug 14*b* by which the hollow primary spindle 14 is secured to the top sub 12. Thus, this metal-to-metal seal is maintained by the compressive force exerted by the spring 15*m*, and the action of the well pressure on 15, hence preventing leakage of well fluids into the control conduit extending to the well surface, in the case of failure of seals 14*s*.

Those skilled in the art will recognize that a rotatable ball valve could be readily utilized in place of the flapper valve and the term "valve head" employed in the claims of this application has been selected to read upon either of these two well known structural versions of downhole safety valves.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a valve for controlling fluid flow in a fluid transmission conduit in a subterranean well comprising:

a tubular valve housing defining an axial fluid passage;

a valve closure member shiftably mounted in said valve housing for movement between an open and closed position relative to said fluid passage;

first resilient means biasing said valve closure member to said closed position;

a valve actuator sleeve concentrically mounted within said tubular valve housing for axial movements between two positions relative to said valve closure member, in one of said two positions shifting said valve closure member to said open position and in the other of said two positions permitting said valve closure member to close;

second resilient means urging said valve actuator sleeve to said other position;

said valve actuator sleeve defining an annular space between its exterior and the axial fluid passage of said housing;

a spindle disposed in said annular space in axially extending relation and having upper end secured to said housing;

said spindle having a hollow bore;

means including a first fluid conduit extending to the surface for supplying pressured fluid to the hollow bore of said spindle;

a primary cylinder having a closed bottom end slidably and sealably mounted on said spindle;

said primary cylinder defining a fluid pressure chamber communicating with the bore of said hollow spindle, whereby pressured fluid supplied to the bore of said hollow spindle urges said primary cylinder downwardly;

a shiftable latch for detachably securing said primary cylinder to said valve actuator sleeve, whereby the supply of pressured fluid through said first fluid conduit shifts said valve closure member to said open position;

a secondary cylinder disposed exteriorly of said valve actuator sleeve in axially extending relation;

a secondary piston slidably and sealably cooperating with the bore of said secondary cylinder;

one of said secondary cylinder and piston being secured to said valve housing and the other of said secondary cylinder and piston being axially movable relative to said valve housing;

second fluid conduit means for supplying pressured fluid to the bore of said secondary cylinder to produce axial movement of said other of said secondary cylinder and piston;

means on said other of said secondary cylinder and piston for engaging and shifting said shiftable latch to disconnect said valve actuator sleeve from said primary cylinder and connect said other of said secondary cylinder and piston to said valve actuator sleeve, whereby pressured fluid supplied to the bore of said secondary cylinder can move said valve actuator sleeve to said valve open position; and locking means operable between said secondary cylinder and piston to lock said secondary cylinder and piston in a relative position corresponding to said valve open position.

2. In a valve for controlling the flow in a fluid transmission conduit in a subterranean well comprising:

a tubular valve housing defining an axial fluid passage;

a valve closure member shiftably mounted in said valve housing for movement between an open and closed position relative to said fluid passage;

first resilient means biasing said valve closure member to said closed position;

a valve actuator sleeve concentrically mounted within said tubular valve housing for axial movements between two positions relative to said valve closure member, in one of said two positions shifting said valve closure member to said open position and in the other of said two positions permitting said valve closure member to close;

second resilient means urging said valve actuator sleeve to said other position;

said valve actuator sleeve defining an annular space between its exterior and the axial fluid passage of said housing;

a spindle disposed in said annular space in axially extending relation and having an upper end secured to said housing;

said spindle having a hollow bore;

means including a first fluid conduit extending to the surface for supplying pressured fluid to the hollow bore of said spindle;

a primary cylinder having a closed bottom end slidably and sealably mounted on said hollow spindle;

said primary cylinder defining a fluid pressure chamber communicating with the bore of said hollow spindle, whereby pressured fluid supplied to the bore of said hollow spindle urges said primary cylinder axially relative to said hollow spindle;

a shiftable latch for detachably securing said primary cylinder to said valve actuator sleeve, whereby the supply of pressured fluid through said first fluid conduit shifts said valve closure member to said open position;

a second spindle disposed in said annular space in axially extending relation and having an upper end secured to said housing;

said second spindle having a hollow bore;

means including a second fluid conduit extending to the surface for supplying pressured fluid to the bore of said second spindle;

a secondary cylinder having a closed bottom end slidably and sealably mounted on said spindle, whereby pressured fluid supplied through said second fluid conduit urges said secondary cylinder axially;

means on said secondary cylinder for engaging and shifting said shiftable latch to disconnect said primary cylinder from said valve actuator sleeve and to connect said secondary cylinder to said valve actuator sleeve; and locking means operable between said secondary cylinder and piston to lock said secondary cylinder and piston in a relative position corresponding to said valve open position.

3. The apparatus of claim 1 or 2 wherein said valve closure member is shifted to said open position by downward movement of said valve actuator sleeve.

4. The apparatus of claim 1 or 2 wherein said locking means comprises wicker threads formed on one of said secondary cylinder and piston, and a radially shiftable locking element mounted on the other of said secondary cylinder and piston and cooperating with said wicker threads in said relative position of said secondary cylinder and piston corresponding to said valve open position of said valve actuator sleeve.

5. In a subterranean well safety valve for controlling the fluid flow through a well conduit and including a housing having a bore and a valve closure member movable between open and closed positions for controlling the fluid flow through the bore;

a tubular member telescopically movable in the housing for controlling the movement of the valve closure member, and biasing means for moving the tubular member in a direction to close the valve;

a primary cylinder in the housing;

a primary piston in and movable relative to the primary cylinder in response to fluid pressure in the primary cylinder;

a shiftable latch for detachably securing one of said primary cylinder and primary piston to said tubular member;

first fluid conduit means for supplying pressured fluid to the bore of said primary cylinder to thereby shift said tubular member in the direction to close said bore by said valve closure member;

a secondary cylinder disposed exteriorly of said valve actuator sleeve in axially extending relation;

a secondary piston slidably and sealably cooperating with the bore of said secondary cylinder;

one of said secondary cylinder and piston being secured to said valve housing and other of said secondary cylinder and piston being axially movable relative to said valve housing;

second fluid conduit means for supplying pressured fluid to the bore of said secondary cylinder to produce axial movement of said other of said secondary cylinder and piston; and means on said other of said secondary cylinder and piston for engaging and shifting said shiftable latch to disconnect said tubular member from one of said primary cylinder and primary piston and connect said other of said secondary cylinder and piston to said tubular member, whereby pressured fluid supplied to the bore of said secondary cylinder can move said tubular member to said valve open position independent of the movable one of said primary cylinder and piston.

6. In a subterranean well safety valve for controlling the fluid flow through a well conduit and including a housing having a bore and a valve closure member movable between open and closed positions for controlling the fluid flow through the bore;

a tubular member telescopically movable in the housing for controlling the movement of the valve closure member, and biasing means for moving the tubular member in a direction to close the valve;

a primary cylinder in the housing;

a primary piston in and movable relative to the primary cylinder in response to fluid pressure in the primary cylinder;

a shiftable latch for detachably securing one of said primary cylinder and primary piston to said tubular member;

first fluid conduit means for supplying pressured fluid to the bore of said primary cylinder to thereby shift said tubular member in the direction to close said bore by said valve closure member;

a secondary cylinder disposed exteriorly of said valve actuator sleeve in axially extending relation;

a secondary piston slidably and sealably cooperating with the bore of said secondary cylinder;

one of said secondary cylinder and piston being secured to said valve housing and other of said secondary cylinder and piston being axially movable relative to said valve housing;

second fluid conduit means for supplying pressured fluid to the bore of said secondary cylinder to produce axial movement of said other of said secondary cylinder and piston;

means on said other of said secondary cylinder and piston for engaging and shifting said shiftable latch to disconnect said tubular member from one of said primary cylinder and primary piston and connect said other of said secondary cylinder and piston to said tubular member, whereby pressured fluid supplied to the bore of said secondary cylinder can move said tubular member to said valve open position independent of the movable one of said primary cylinder and piston; and locking means operable between said secondary cylinder and piston to lock said secondary cylinder and piston in a relative position corresponding to said valve open position.

7. The apparatus of claim 6 wherein said locking means comprises wicker threads formed on one of said secondary cylinder and piston and a radially shiftable lock element mounted on the other of said secondary cylinder and piston and cooperating with said wicker threads in a relative position of said secondary cylinder and piston corresponding to said valve open position of said tubular member.

8. The apparatus of claim 5 wherein said second fluid conduit means comprises a valve housing;

means for securing said valve housing to the exterior of said well conduit;

said valve housing defining an axially extending fluid passage connectable at its upper end with a control fluid conduit extending to the surface and at its lower end with said second fluid conduit means; and metallic check valve means in said fluid passage preventing upward flow of fluid through said fluid passage.

9. The apparatus of claim 6 wherein said second fluid conduit means comprises a valve housing;

means for securing said valve housing to the exterior of said well conduit;

said valve housing defining an axially extending fluid passage connectable at its upper end with a control fluid conduit extending to the surface and at its lower end with said second fluid conduit means; and metallic check valve means in said fluid passage preventing upward flow of fluid through said fluid passage.

10. The apparatus of claim 8 or 9 further comprising a frangible disc traversing said fluid passage and preventing downward flow of control fluid until the control fluid pressure attains a predetermined pressure sufficient to fracture said frangible disc.

11. The apparatus of claims 5, 6 or 8 further comprising an annular metal seal disc sealably secured between said secondary piston and said secondary cylinder to prevent entry of well fluids into said secondary cylinder, said seal disc being shearable by the fluid pressure force developed between said piston and cylinder by fluid supplied through said secondary conduit means.

12. The method of operating a downhole well valve by pressurized control fluids supplied from the surface, said downhole valve having a valve actuating member shiftable between a valve closing and valve opening position;

a primary fluid pressure actuator operable by a first pressurized control fluid;

a secondary fluid pressure actuator operable by a second pressurized control fluid, the steps comprising:

(1) securing said primary fluid pressure actuator to said valve actuating member by a shiftable latch, whereby said valve may be shifted from its closed to its open position by said first pressurized control fluid; and (2) shifting said latch at any position of said primary actuator to concurrently disconnect said primary actuator from said valve actuating member and connect said secondary actuator to said valve actuating member by movement of said secondary actuator produced by said second pressurized control fluid.

13. The method of claim 12 further comprising the step of locking said secondary actuator in its position corresponding to the valve open position of said valve actuating member.

14. The method of claim 13 wherein said valve actuator member comprises an axially shiftable sleeve and said primary and secondary actuator are disposed externally of said sleeve and movable parallel to said sleeve axis.

15. The method of claim 14 wherein said latch is shifted in a plane perpendicular to said sleeve axis.

16. The method of claim 12 or 13 further comprising the step of forming an integral metal seal across an end of the secondary fluid pressure actuator exposed to well fluids and shearing said integral seal by movement of said secondary actuator produced by said second pressurized control fluid.

17. The method of claim 12 or 13 wherein said secondary actuator comprises a cylinder having one closed end and an open end, and a piston mounted on a hollow spindle projecting through said open cylinder end, the further steps comprising:

welding an annular metal disc seal to the open end of said cylinder and to the exterior of said hollow spindle; and supplying said second pressurized control fluid through said hollow spindle to produce a force sufficient to shear said annular metal disc seal.

18. The method of operating a downhole well valve by pressurized control fluids supplied from the surface, said downhole valve having a valve actuating member shiftable between a valve closing and valve opening position;

a primary fluid pressure actuator operable by a first pressurized control fluid;

a secondary fluid pressure actuator operable by a second pressurized control fluid, the steps comprising:

(1) securing said primary fluid pressure actuator to said valve actuating member by a shiftable latch, whereby said valve may be shifted from its closed to its open position by said first pressurized control fluid;

(2) shifting said latch at any position of said primary actuator to concurrently disconnect said primary actuator from said valve actuating member and connect said secondary actuator to said valve actuating member by movement of said secondary actuator produced by said second pressurized control fluid; and (3) inserting a check valve in a conduit supplying said second fluid pressure to said secondary fluid pressure actuator to prevent upward flow of well fluids through the conduit.

19. The method of operating a downhole well valve by pressurized control fluids supplied from the surface, said downhole valve having a valve actuating member shiftable between a valve closing and valve opening position;

a primary fluid pressure actuator operable by a first pressurized control fluid;

a secondary fluid pressure actuator operable by a second pressurized control fluid, the steps comprising:

(1) securing said primary fluid pressure actuator to said valve actuating member by a shiftable latch, whereby said valve may be shifted from its closed to its open position by said first pressurized control fluid;

(2) shifting said latch at any position of said primary actuator to concurrently disconnect said primary actuator from said valve actuating member and connect said secondary actuator to said valve actuating member by movement of said secondary actuator produced by said second pressurized control fluid;

(3) locking said secondary actuator in its position corresponding to the valve open position of said valve actuating member; and (4) inserting a check valve in a conduit supplying said second fluid pressure to said secondary fluid pressure actuator to prevent upward flow of well fluids through the conduit.

20. The method of claim 19, said valve actuator member comprising an axially shiftable sleeve and said primary and secondary actuator being disposed externally of said sleeve and movable parallel to said sleeve axis.

21. The method of claim 19, said valve actuator member comprising an axially shiftable sleeve and said primary and secondary actuator being disposed externally of said sleeve and movable parallel to said sleeve axis, and wherein said latch is shifted in a plane perpendicular to said sleeve axis.

* * * * *